US006044647A

United States Patent [19]

Drube et al.

[11] Patent Number: 6,044,647

[45] Date of Patent: Apr. 4, 2000

[54] TRANSFER SYSTEM FOR CRYOGENIC LIQUIDS

[75] Inventors: Thomas K. Drube, Lakeville; Paul A. Drube, Applevalley; A. Duane Preston, New Prague, all of Minn.

[73] Assignee: MVE, Inc., New Prague, Minn.

[21] Appl. No.: 08/906,512

[22] Filed: Aug. 5, 1997

[51] Int. Cl.[7] ..... F17C 7/02

[52] U.S. Cl. ..... 62/50.1; 62/50.2; 141/2; 141/4

[58] Field of Search ..... 62/50.1, 50.2, 62/50.4, 50.6; 141/2, 4, 18

[56] References Cited

U.S. PATENT DOCUMENTS 4,475,348 10/1984 Remes .
5,121,609 6/1992 Cieslukowski .
5,127,230 7/1992 Neeser et al. .
5,163,409 11/1992 Gustafson et al. .
5,228,295 7/1993 Gustafson .
5,231,838 8/1993 Cieslukowski .
5,360,139 11/1994 Goode .
5,373,702 12/1994 Kalet et al. .
5,421,160 6/1995 Gustafson et al. .
5,421,162 6/1995 Gustafson et al. .
5,505,232 4/1996 Barclay .
5,537,824 7/1996 Gustafson et al. .
5,548,962 8/1996 Luger et al. .
5,687,776 11/1997 Forgash et al. .
5,699,839 12/1997 Dehne .

*Primary Examiner*—Christopher B. Kilner
*Attorney, Agent, or Firm*—Rudnick & Wolfe

[57] ABSTRACT

A cryogenic liquid transfer system, for servicing a use device, releases stored cryogen from a bulk storage tank to a gas supply tank and a dispenser tank. The liquid cryogen in the gas supply tank is circulated through a circuit that includes a heat exchanger and the gas thus generated is returned to the gas supply tank so as to pressurize it. The pressurized liquid cryogen is released from the gas supply tank so that it flows through a vaporizer. The gas produced by the vaporizer is bubbled through the liquid cryogen in the dispenser tank so as to raise its temperature and pressure to the level required by the use device being serviced. Gas from the vaporizer is then delivered to the space above the liquid cryogen in the dispenser tank to as to create a pressure head that will cause the liquid cryogen to flow to the use device upon release. A venturi is connected to the tubing between the gas supply tank and the dispenser tank and is used to reduce the pressure in the bulk storage tank.

23 Claims, 2 Drawing Sheets

TRANSFER SYSTEM FOR CRYOGENIC LIQUIDS

BACKGROUND

The present invention generally relates to delivery or transfer systems for cryogenic liquids and, more particularly, to a transfer system that delivers liquified natural gas (LNG) fuel to a vehicle fuel tank without using a pump or compressor and conditions the LNG to the desired temperature and pressure while keeping the pressure in the system's bulk storage tank at a desired low level.

LNG is one alternative energy source which is domestically available, environmentally safe and plentiful when compared to oil. As a result, the use of LNG as a fuel for vehicles such as buses, trucks and the like has greatly increased. Entire fleets of government and industry vehicles, as well as some privately-owned vehicles, have been successfully converted to LNG power. These developments have necessitated a focus on the development of LNG transfer systems for delivering natural gas from a bulk storage tank to LNG-powered vehicles.

In contrast to conventional fuels such as gasoline, LNG is a cryogenic liquid and thus has a boiling point below −150° F. at atmospheric pressure. Most LNG-powered vehicles, however, require that the LNG be delivered at a pressure above atmospheric pressure. This is because in the typical LNG-powered vehicle fuel system, the driving force to deliver the LNG from the vehicle fuel tank to the engine is the pressure of the fuel itself In other words, the vehicle employs no pump or other means of moving the fuel. Instead, the fuel is stored in the vehicle fuel tank at a pressure sufficient to force the fuel to the engine. It is thus necessary to increase the pressure of the LNG stored in the transfer system prior to its delivery to the vehicle.

Pressurizing the LNG stored in the transfer system by merely adding gas to the system storage tank, without heating the LNG stored therein, is ineffective. This is because the LNG, once delivered to the use vehicle, sloshes around in the use vehicle's fuel tank as the vehicle is driven. This results in condensation of the added gas which decreases the pressure of the LNG to a level that is below the requirements of the use vehicle. In order to avoid this condensation, the LNG must be in a saturated state at the higher pressure level. In other words, the pressurization must result in an equilibriated pressure.

This pressurization is accomplished by heating the LNG to a higher temperature before delivery to the vehicle. This heating results in an increase in the pressure of the LNG until it reaches equilibrium at the saturation pressure for the higher temperature. The higher temperature is chosen so that its saturation pressure is approximately equal to the pressure required by the vehicle. The LNG is thus conditioned so as to be at the proper pressure required by the vehicle to which the pressurized LNG may then be distributed.

An increase in pressure of the stored LNG, however, makes filling of the bulk storage tank from a low pressure transport difficult or impossible without first venting the vaporized cryogen to reduce the pressure in the bulk storage tank. This venting is undesirable in that once the bulk storage tank is refilled, the pressurization process must be repeated, which means that more LNG must be boiled off as vapor. This decreases the amount of LNG available for distribution and is potentially hazardous. A need thus exists for a transfer system that can condition the LNG to a high pressure for vehicle use while maintaining a desired low pressure in the bulk storage tank.

Accordingly, an object of the invention is to provide a transfer system that can condition the cryogen to the desired pressure and temperature while maintaining a desired low pressure in the bulk storage tank.

Existing transfer systems commonly use pumps or compressors to establish the flow of pressurized LNG from the transfer system bulk storage tanks to LNG-powered vehicles. In addition, some transfer systems also use pumps or compressors to circulate the LNG through heating circuits for pressurization purposes. Such specialized pumps or compressors feature moving parts which wear and thus require repair, replacement and maintenance. These costs are considerable. Furthermore, pumps or compressors add considerable cost to the production, and thus purchase price, of a transfer system. These repair, replacement, maintenance and initial costs are multiplied for transfer systems that use a number of pumps and compressors. It would thus be a significant advantage if a transfer system could function without pumps or compressors.

As such, another object of the invention is to provide a cryogenic transfer system that conditions and delivers the cryogen without the need of a pump or compressor.

SUMMARY

The present invention is directed to a transfer system for conditioning cryogenic liquids and dispensing them to a use device without the use of a pump or compressor. The transfer system accomplishes this while maintaining a low pressure in its bulk storage tank. The transfer system features a bulk storage tank which supplies LNG to a gas supply tank and a dispenser tank. The LNG that is contained in the gas supply tank is circulated through a fluid circuit that includes a heat exchanger. The gas generated by the heat exchanger is returned to the gas supply tank so as to pressurize it. The pressurized LNG is released from the gas supply tank so that it flows through a vaporizer. The gas generated by the vaporizer is transferred to the dispenser tank and bubbled through the LNG contained therein via a sparger line. This heats the LNG in the dispenser tank so that it comes to equilibrium at a saturation pressure required by a use vehicle. Gas from the vaporizer is then transferred to the space above the LNG in the dispenser tank so as to create a pressure head that causes the LNG to flow to the fuel tank of a use device upon release. A venturi is in fluid communication between the gas supply tank and the dispenser tank. A line leads from the top of the bulk storage tank to the venturi so that pressure within the bulk storage tank is decreased when a sufficient pressure drop occurs across the venturi.

For a more complete understanding of the nature and scope of the invention, reference may now be had to the following detailed description of embodiments thereof taken in conjunction with the appended claims and accompanying drawings.

DESCRIPTION

Figure 1:
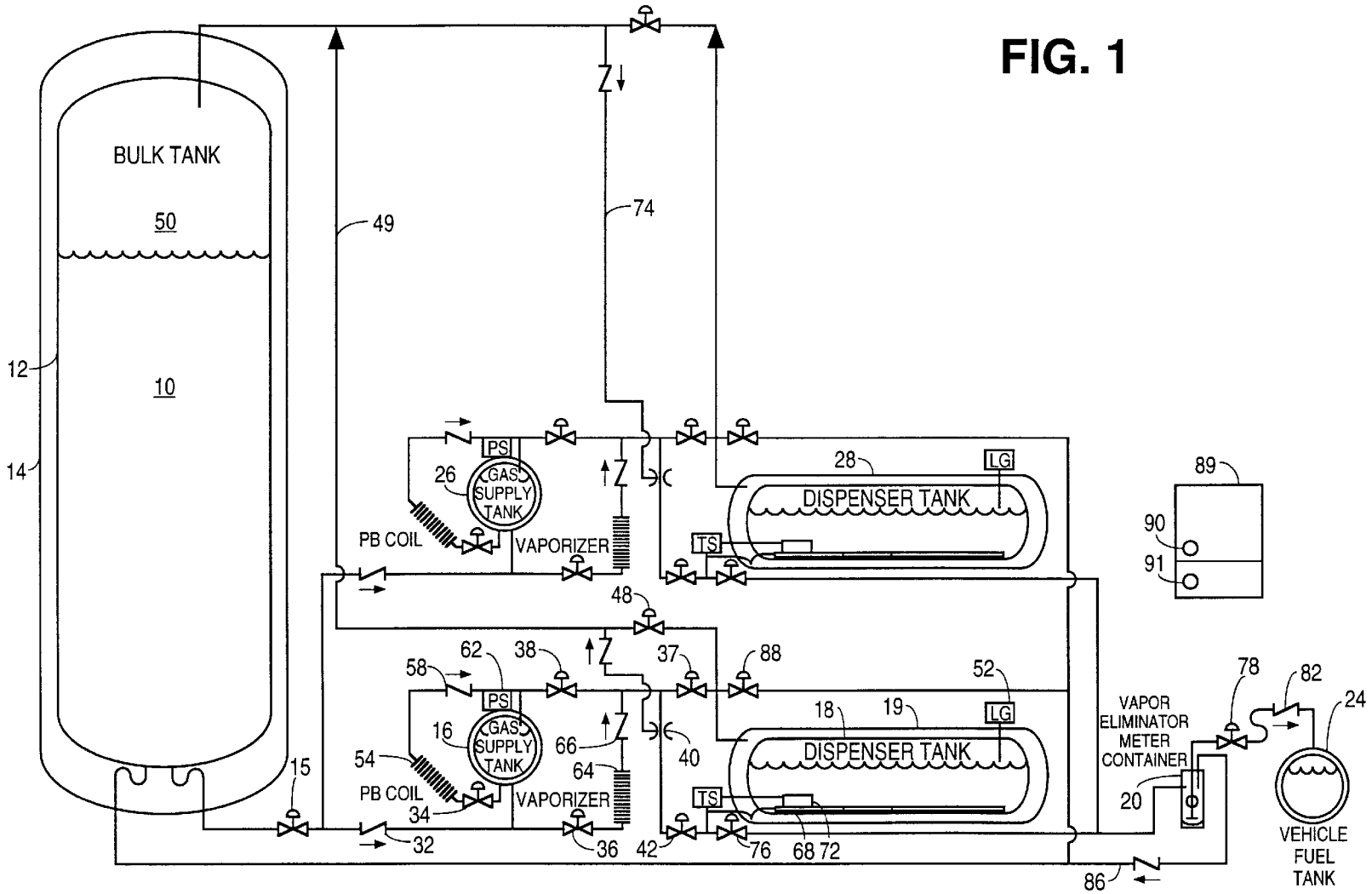
FIG. 1 is a schematic diagram of an embodiment of the cryogenic liquid transfer system of the present invention.

Referring to FIG. 1, an embodiment of the cryogenic liquid transfer system of the present invention is shown. As shown in FIG. 1, liquid natural gas (LNG) 10 is stored in cryogenic bulk storage tank 12. Bulk storage tank 12 is insulated and surrounded by outer jacket 14. The annular space formed by tank 12 and jacket 14 is generally evacuated to a high vacuum to improve the insulation efficiency.

When a valve, indicated at 15, is opened, LNG flows out of the bottom of bulk storage tank 12, via gravity, and through a fluid circuit that includes gas supply tank 16 and dispenser tank 18. These two components, as will be explained, replace the pumps and compressors found in existing transfer systems. In addition, associated components condition the LNG to the pressure required by the use device. Dispenser tank 18 is insulated with jacket 19. When the system is dispensing LNG to a use device, conditioned LNG flows from dispenser tank 18, through vapor eliminator/meter container 20 and into the fuel tank 24 of a use device.

A second gas supply tank 26 and second dispenser tank 28 are connected in parallel with gas supply tank 16 and dispenser tank 18 so that one set of tanks may be filled from bulk storage tank 12, and the LNG within that set conditioned, while the other set is dispensing to fuel tank 24. This arrangement provides for uninterrupted operation of the transfer system. Isolation valves (not shown) are used to determine whether bulk storage tank 12 is in fluid communication with gas supply and dispenser tanks 16, 18 or gas supply and dispenser tanks 26, 28.

Figure 2:
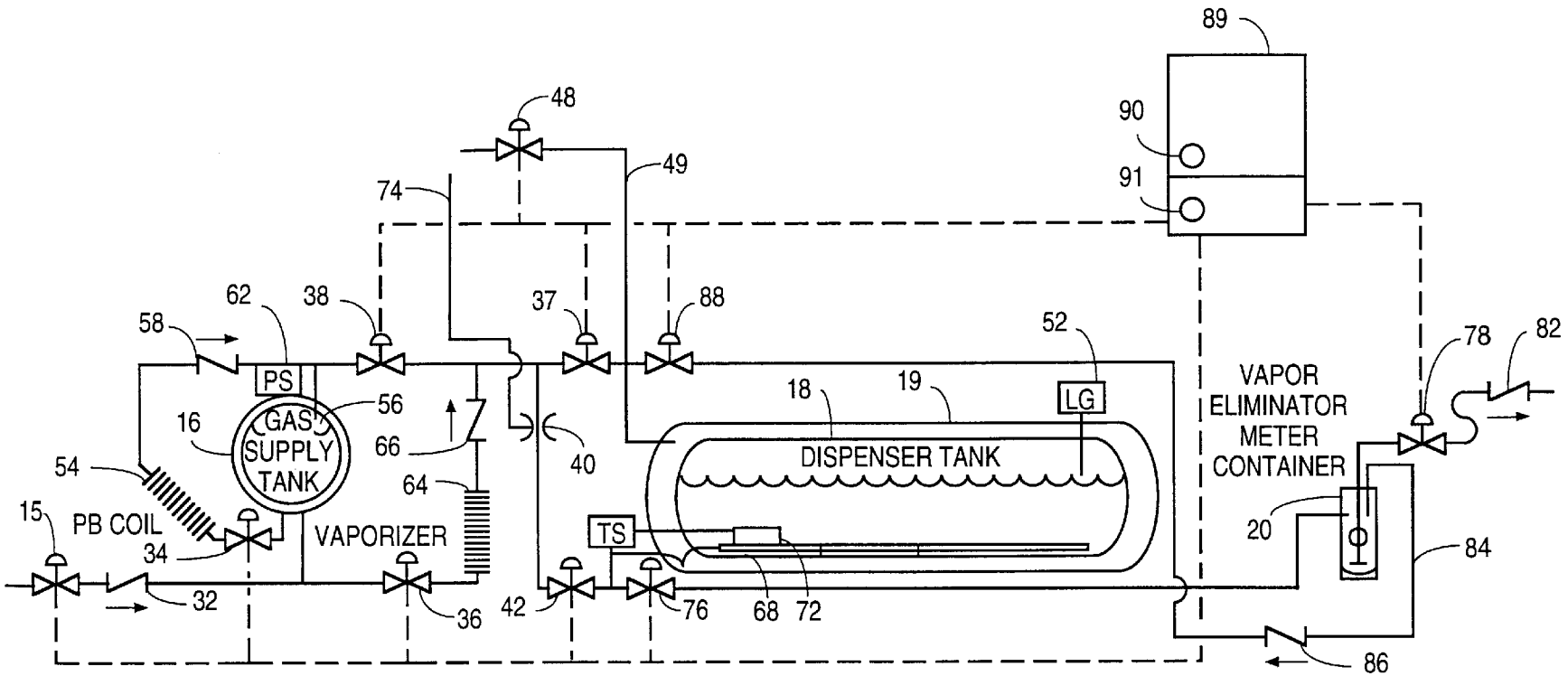
FIG. 2 is an enlarged, simplified schematic diagram of the cryogenic liquid transfer system of FIG. 1 showing the gas supply and dispenser tanks.

Turning to FIG. 2, LNG flowing from bulk storage tank 12 of FIG. 1 flows through valve 15, check valve 32 and into gas supply tank 16. During this time, valve 34, 36 and 37 are closed. When the level of LNG reaches an outlet near the top of gas supply tank 16, the LNG flows into dispenser tank 18 through valve 38, venturi 40 and valve 42. As the liquid flows into gas supply tank 16 and dispenser tank 18, gas in the tanks is returned to bulk storage tank 12 through valve 48 and line 49. As shown in FIG. 1, this gas is deposited into gas space 50. Dispenser tank 18 continues to fill until level gauge and switch 52 stops the fill by closing valve 15.

Next, valve 38 is closed and valve 34 is opened. Gas supply tank 16 is then pressurized to a relatively higher pressure by circulating the LNG stored therein through valve 34, via gravity, to heat exchanger 54 and returning the gas thus generated to gas space 56 through check valve 58. This increases the pressure in gas supply tank 16 to a level sufficient to meet the conditioning requirements of dispenser tank 18. The pressure is controlled by pressure switch 62 which opens and closes valve 34.

Once the LNG within gas supply tank 16 has reached the required pressure, valve 34 is closed and valve 36 is opened. Due to the increase in pressure within gas supply tank 16, the LNG stored therein flows through valve 36 into heat exchanger vaporizer 64. The gas thus generated flows through check valve 66, venturi 40, and valve 42 into sparger line 68 disposed at the bottom of dispenser tank 18. As is known in the art, sparger line 68 consists of a pipe featuring a large number of small holes that are spaced apart. As such, sparger line 68 bubbles the gas from the gas supply tank through the LNG of dispenser tank 18 in a form that is easily condensed. This raises the temperature of the LNG thus increasing the pressure to the level required by the vehicle being serviced. When the temperature and pressure reaches the desired level, pressure/temperature sensor 72 causes valve 42 to close thus stopping the gas flow to dispenser tank 18.

Pressure/temperature sensor 72, which is disposed at the bottom of dispenser tank 18, consists of a housing containing a small quantity of LNG. The LNG contained within sensor 72 assumes the same temperature as the surrounding LNG in dispenser tank 18. It follows that the LNG within sensor 72 is at the same pressure as the surrounding LNG in dispenser tank 18. As such, pressure/temperature sensor 72 can be used to transmit a signal to valve 42 causing it to close or open when a predetermined temperature and pressure level is detected within dispenser tank 18. As an alternative to pressure/temperature 72, a thermocouple, resistance temperature detector (RTD), thermistor or similar temperature or pressure measuring device may be employed.

While the LNG is flowing from relatively high pressure gas supply tank 16 through vaporizer 64 and venturi 40 into the relatively lower pressure in dispenser tank 18, the venturi 40 reduces the pressure in line 74 permitting gas 50 to flow out of bulk storage tank 12 (FIG. 1). This prevents a pressure rise in bulk storage tank 12 that would lead to the venting of gas or difficulty in filling tank 12 from a low pressure transport tank. Venturi 40 functions to reduce the pressure in bulk storage tank 12, however, only when the pressure at the outlet of venturi 40 is below the pressure within bulk storage tank 12.

When it is desired to fill the fuel tank 24 of a use device (FIG. 1), a proper connection is made between valve 78 and tank 24 and fill switch 90 is operated. This causes a controller 89 (electronic sequencer or microcomputer type) to operate the proper valves to start the fill as follows. First, the pressure of the LNG in dispenser tank 18 must be increased so that the fluid therein will be induced to flow into tank 24. To accomplish this, valve 34 is opened which causes LNG to flow from gas supply tank 16 through heat exchanger 54 where it is vaporized. This vapor is delivered back to tank 16 so as to pressurize it. Next, valves 36 and 37 are opened and LNG again flows from gas supply tank 16 through valve 36 into vaporizer 64 where it is vaporized. The vapor then flows through check valve 66 and valve 37 into the gas space above the LNG of dispenser tank 18 thereby increasing the pressure of the LNG therein. Due to this pressure increase, when valves 76 and 78 are opened, LNG flows from dispenser tank 18 through valve 76, meter 20, valve 78 and check valve 82 into use device fuel tank 24 (FIG. 1). When vehicle fuel tank 9 is properly filled, the pressure in the delivery hose rises, the fuel flow decreases, and meter 20 transmits signals to close valves 76 and 78 to stop the dispensing. System switch 91 may be operated to cause microcomputer controller 89 to close all of the system valves so as to completely shut down the system.

Meter 20, and the associated tubing 84, check valve 86 and valve 88, operate so as to provide accurate metering of the LNG dispensed. The details of their operation are disclosed in U.S. Pat. No. 5,616,838 to Preston et al.

While the preferred embodiments of the invention have been shown and described, it will be apparent to those skilled in the art that changes and modifications may be made therein without departing from the spirit of the invention, the scope of which is defined by the appended claims.

What is claimed is:

1. A transfer system for dispensing cryogenic liquid to a use device, the transfer system comprising:

a) a bulk storage tank containing the cryogenic liquid;

b) a dispenser tank in fluid communication with the bulk storage tank and the use device;

c) a gas supply tank in series circuit between the bulk storage tank and the dispenser tank so that cryogenic liquid may flow from said bulk tank through said gas supply tank to said dispenser tank;

d) said dispenser tank and gas supply tank fed by gravity with the cryogenic liquid from the bulk storage tank;

e) means for pressurizing the cryogenic liquid within the gas supply tank so that the cryogenic liquid within the gas supply tank flows through a vaporizer that is in fluid communication with the gas supply tank;

f) said vaporizer in fluid communication with the dispenser tank so that gas produced thereby increases the pressure of the cryogenic liquid within the dispenser tank to a level required by the use device and by an amount necessary to propel the cryogenic liquid within the dispenser tank to the use device; and g) means for delivering cryogenic liquid from the dispenser tank to the use device.

2. The transfer system of claim 1 further comprising means for decreasing pressure within the bulk storage tank.

3. The transfer system of claim 2 wherein the means for decreasing pressure within the bulk storage tank includes a venturi and tubing with the venturi in circuit between the vaporizer and the dispenser tank and the tubing in fluid communication between the venturi and the bulk storage tank.

4. The transfer system of claim 1 wherein the means for delivering cryogenic liquid from the dispenser tank to the use device includes a meter.

5. The transfer system of claim 1 wherein the means for pressurizing the gas supply tank includes:

a) a heat exchanger having an inlet and an outlet;

b) tubing in fluid communication between the gas supply tank and the inlet of the heat exchanger;

c) tubing in fluid communication between the outlet of the heat exchanger and the gas supply tank; and d) said cryogenic liquid in the gas supply tank flowing by gravity through the heat exchanger and returning to the gas supply tank.

6. The transfer system of claim 5 further comprising a valve in circuit with the tubing between the gas supply tank and the inlet of the heat exchanger.

7. The transfer system of claim 6 further comprising a pressure sensor operatively connected to the gas supply tank, said pressure sensor in communication with said valve.

8. The transfer system of claim 1 further comprising a sparger line in fluid communication with the vaporizer and the dispenser tank, said sparger line disposed in the bottom of the dispenser tank.

9. The transfer system of claim 1 further comprising a valve in circuit between the gas supply tank and the vaporizer.

10. The transfer system of claim 9 further comprising a temperature sensor operatively connected to the dispenser tank, said temperature sensor in communication with said valve.

11. The transfer system of claim 1 further comprising a redundant gas supply tank and a redundant dispenser tank connected in parallel with said gas supply tank and said dispenser tank between said bulk storage tank and said use device.

12. The transfer system of claim 1 further comprising means for automatically sequencing the system.

13. A transfer system for dispensing cryogenic liquids to a use device, the transfer system comprising:

a) a bulk storage tank containing a supply of the cryogenic liquid;

b) a dispenser tank in fluid communication with said bulk storage tank and said use device;

c) a gas supply tank in series circuit between the bulk storage tank and the dispenser tank so that cryogenic liquid may flow from said bulk tank through said gas supply tank to said dispenser tank, said gas supply tank and said dispenser tank gravity fed with the cryogenic liquid from the bulk storage tank;

d) a heat exchanger in fluid communication with the gas supply tank, said heat exchanger gravity fed with cryogenic liquid from the gas supply tank so that the gas supply tank is pressurized with heated cryogenic liquid returned from the heat exchanger;

e) a vaporizer in circuit between the gas supply tank and the dispenser tank, said vaporizer pressure fed with cryogenic liquid from the gas supply tank so that a gas is produced, said gas heating the cryogenic liquid within the dispenser tank so that the cryogenic liquid is pressurized to a level required by the use device, said gas also pressurizing the cryogenic liquid within the dispenser tank so that it may be delivered to the use device; and f) means for delivering the cryogenic liquid from the dispenser to the use device.

14. The transfer system of claim 13 further comprising means for decreasing pressure within the bulk storage tank.

15. The transfer system of claim 14 wherein the means for decreasing pressure within the bulk storage tank includes a venturi and tubing with the venturi in circuit between the vaporizer and the dispenser tank and the tubing in fluid communication between the venturi and the bulk storage tank.

16. The transfer system of claim 13 wherein the means for delivering cryogenic liquid from the dispenser tank to the use device includes a meter.

17. The transfer system of claim 13 further comprising a sparger line in fluid communication with the vaporizer and the dispenser tank, said sparger line disposed in the bottom of the dispenser tank.

18. The transfer system of claim 13 further comprising a redundant gas supply tank and a redundant dispenser tank connected in parallel with said gas supply tank and said dispenser tank between said bulk storage tank and said use device.

19. The transfer system of claim 13 further comprising means for automatically sequencing the system so as to effect the transfer of the cryogenic liquids to the use device.

20. A method of dispensing cryogenic liquid to a use device which comprises the steps of:

a) storing the cryogenic liquid in a bulk storage tank;

b) transferring the cryogenic liquid from the bulk storage tank to a gas supply tank by gravity;

c) transferring cryogenic liquid from the gas supply tank to the dispenser tank when at least a portion of the gas supply tank is full;

d) pressurizing the cryogenic liquid in the gas supply tank;

e) releasing the cryogenic liquid from the gas supply tank so that it flows through a vaporizer;

f) vaporizing the cryogenic liquid in the vaporizer so as to produce a cryogenic gas;

g) transferring the cryogenic gas to the cryogenic liquid within the dispenser tank to heat and pressurize the cryogenic liquid within the dispenser tank to a level required by the use device;

h) transferring the cryogenic gas to a space above the cryogenic liquid within the dispenser tank to pressurize the cryogenic liquid in the dispenser tank to a pressure that is sufficiently higher than that of a fuel tank of the use device so that the cryogenic liquid will flow to the fuel tank of the use device upon release; and i) releasing the cryogenic liquid from the dispenser tank so that it flows to the fuel tank of the use device.

21. The method of claim 20 wherein the step of pressurizing the cryogenic liquid in the gas supply tank includes the steps of:

a) circulating the cryogenic liquid within the gas supply tank through a heat exchanger so as to produce a cryogenic gas; and b) returning the cryogenic gas to the gas supply tank.

22. The method of claim 20 further comprising the step of depressurizing the bulk storage tank.

23. The method of claim 20 further comprising the step of metering the cryogenic liquid as it is transferred to the fuel tank of the use device.

* * * * *